US010227823B2

(12) United States Patent
Hern et al.

(10) Patent No.: US 10,227,823 B2
(45) Date of Patent: Mar. 12, 2019

(54) WINDOW MILL HYDRAULIC LINE CONNECTION

(71) Applicant: BAKER HUGHES, A GE COMPANY, LLC, Houston, TX (US)

(72) Inventors: Gregory L. Hern, Porter, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/585,747

(22) Filed: May 3, 2017

(65) Prior Publication Data

US 2018/0320448 A1 Nov. 8, 2018

(51) Int. Cl.

| | |
|---|---|
| ***E21B 7/06*** | (2006.01) |
| ***E21B 23/01*** | (2006.01) |
| ***E21B 34/10*** | (2006.01) |
| ***E21B 29/06*** | (2006.01) |

(52) U.S. Cl.

CPC ..... *E21B 7/067* (2013.01); *E21B 7/061* (2013.01); *E21B 23/01* (2013.01); *E21B 29/06* (2013.01); *E21B 34/103* (2013.01)

(58) Field of Classification Search

CPC ..... E21B 7/067

See application file for complete search history.

(56) References Cited

U.S. PATENT DOCUMENTS

| | | | | |
|---|---|---|---|---|
| 6,050,334 | A * | 4/2000 | McGarian | E21B 7/061 166/117.6 |
| 8,739,900 | B2 | 6/2014 | Gregurek et al. | |
| 8,997,895 | B2 | 4/2015 | Swadi et al. | |
| 9,004,159 | B2 | 4/2015 | Alsup et al. | |
| 2016/0348456 | A1 * | 12/2016 | LaPlante | E21B 29/06 |

* cited by examiner

*Primary Examiner* — D. Andrews
*Assistant Examiner* — Dany E Akakpo
(74) *Attorney, Agent, or Firm* — Shawn Hunter

(57) ABSTRACT

A piston has a hydraulic line going through it and is held in position with one or more shear pins or similar breakable retainers. The piston blocks the flow to the window mill circulation ports until a pressure level is reached that breaks the breakable members to allow the piston to move. The piston moves into a larger bore to allow bypass flow through lateral openings. The piston is captured in the larger diameter chamber after passing the lateral openings. Piston movement pushes out some of the high pressure tubing through the window mill where initial rotation of the window mill along the whipstock face causes the extending tubing to be ground off. A rupture disc and high pressure hoses are no longer needed for a significant cost savings from prior designs.

18 Claims, 1 Drawing Sheet

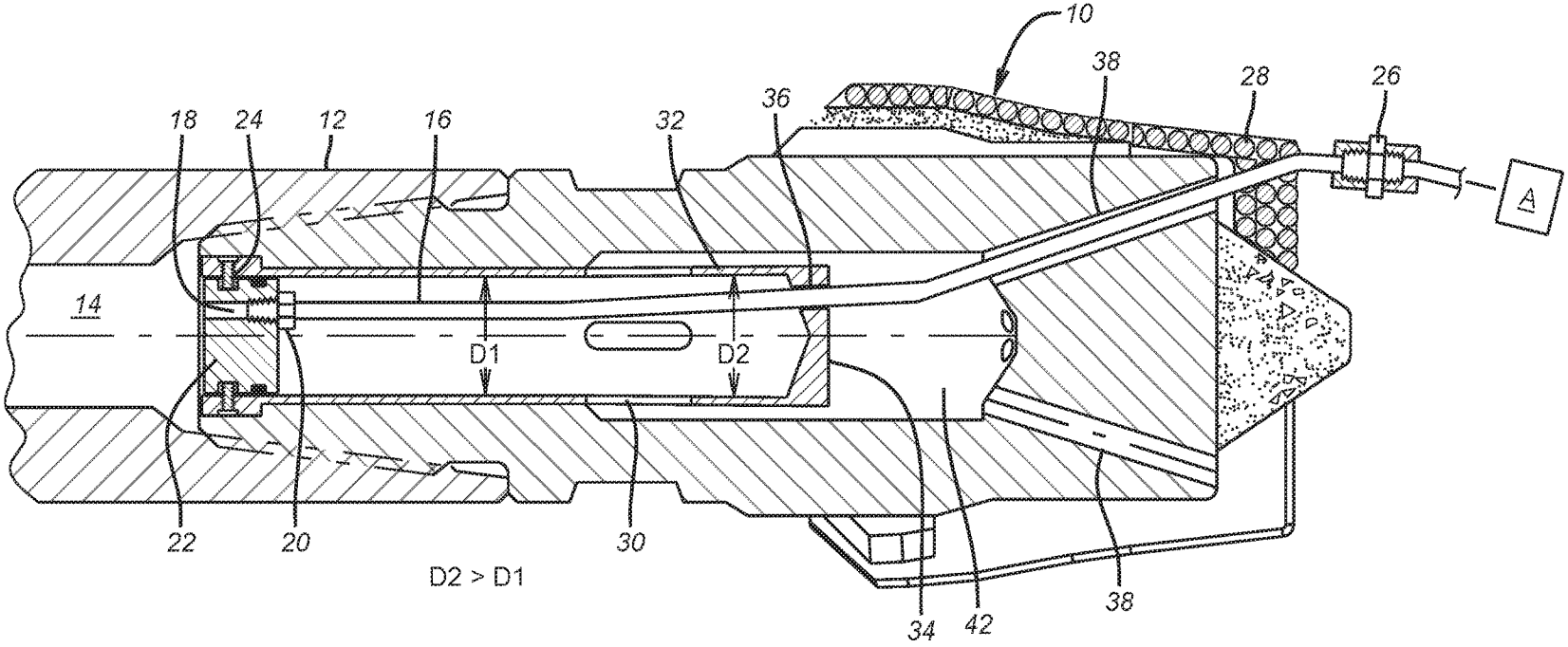
A
26
28
38
10
38
42
34
36
D2
32
30
D1
D2 > D1
16
12
20
24
18
22
14

WINDOW MILL HYDRAULIC LINE CONNECTION

FIELD OF THE INVENTION

The field of the invention is borehole sidetrack milling assemblies using an anchor supporting a whipstock and a milling assembly and more particularly a way to hydraulically set the anchor after whipstock orientation without using a rupture disc to isolate window mill circulation ports.

BACKGROUND OF THE INVENTION

Typically when making a lateral exit from a borehole, a whipstock is run in with an anchor and a mill assembly is attached above the whipstock. The whipstock is oriented at the proper depth in a variety of ways and once the orientation for the whipstock ramp is obtained, the anchor is typically set hydraulically. Typically, pressure is delivered through the running string and into the widow mill that is releasably secured to the top of the whipstock. The anchor has to be set before the mill assembly can be sheared loose from the whipstock ramp by applied axial force or rotation. In order to deliver the needed pressure at the anchor to set the anchor, the circulation ports in the window mill are typically isolated with a rupture disc. The pressure in the running string is built up to a first level to set the anchor. This is made possible by the rupture disc blocking the circulation ports in the window mill. After the anchor is set the pressure is further built up to break the rupture disc so that flow from the running string can exit the circulation ports in the window mill as the string is rotated to break the shearable support that connected the milling bottom hole assembly to the top of the whipstock ramp. The mills are then advanced and the whipstock ramp guides the window mill to start a lateral opening in the surrounding tubular that will then be extended into a lateral from a main bore.

What is a shortcoming of this design is that it is expensive. Not only is there a high cost for the rupture disc but the connection between the window mill and the hydraulic anchor that has to span the length of the whipstock has been in the past a braided hose which has limited pressure rating and is also very expensive. The limited pressure rating affected the available setting pressure for the hydraulic anchor.

Some typical examples of the dual pressure systems that built pressure to a first level with the window mill circulation ports isolated with a rupture disc and then raised pressure to a second level to break the rupture disc to make the window mill circulation ports operational are: U.S. Pat. No. 9,004,159 FIG. 4; U.S. Pat. No. 8,739,900 FIG. 8 and U.S. Pat. No. 8,997,895 FIG. 4.

The present invention makes it possible to set the hydraulic anchor without needing a rupture disc for the window mill circulation ports. The hydraulic line passes through a piston and is connected to that piston. The piston is held in position with one or more shear pins or the like and when the pressure has been increased to set the anchor and then further increased to break the shear pin or the like the piston moves into a larger bore to expose ports to allow flow into the window mill circulation ports as the piston itself is captured in the chamber. High pressure tubing is pushed forward with the piston until the piston travel ends. Pulling the running string upward after breaking the shear bolt that attaches the window mill to the whipstock will assist moving the piston to the bottom of the piston housing. Tubing extending from the cutting structure of the window mill is simply ground off when the window mill is released from the whipstock ramp and milling the window begins. These and other aspects of the present invention will be more readily apparent to those skilled in the art from a review of the description of the preferred embodiment and the associated drawing while recognizing that the full scope of the invention is to be determined from the appended claims.

SUMMARY OF THE INVENTION

A piston has a hydraulic line going through it and is held in position with one or more shear pins or similar breakable retainers. The piston blocks the flow to the window mill circulation ports until a pressure level is reached that breaks the breakable members to allow the piston to move. The piston moves into a larger bore to allow bypass flow through lateral openings. The piston is captured in the larger diameter chamber after passing the lateral openings. Piston movement pushes out some of the high pressure tubing through the window mill where initial rotation of the window mill along the whipstock face causes the extending tubing to be ground off. A rupture disc and high pressure hoses are no longer needed for a significant cost savings from prior designs.

BRIEF DESCRIPTION OF THE DRAWING

FIG. 1 shows the piston in an initial position where pressure can set the whipstock anchor before flow is opened to circulation ports in the window mill.

DETAILED DESCRIPTION OF THE PREFERRED EMBODIMENT

FIG. 1 shows a window mill 10 below a lower watermelon mill 12 as part of a typical and well known assembly that has a hydraulically set anchor (not shown) at the bottom and a whipstock (also not shown) attached above the anchor. The window mill 10 is typically shearably attached to the top of the whipstock ramp. Pressurized fluid from a surface location comes down a tubular string (not shown) and eventually gets to passage 14 just above the window mill 10. A hydraulic tubing line 16 has an upper end 18 and is secured with nut 20 into piston 22. Piston 22 is held fixed by one or more shear members 24 that can be pins or rings, for example. Hydraulic line 16 ends at anchor A. A coupling 26 can be located right below the cutting structure 28 of the window mill 10. Piston 22 closes off flow to ports 30 in housing 32 that has a closed lower end 34 and an opening 36 for the tubing 16 to pass through as shown. Ports 30 are in a portion of the housing 32 that has a larger diameter D2 than the diameter D1 of the piston 22.

After pressure to a first level sets the anchor A with flow through tubing line 16 in the window mill 10, the pressure is further built up to break the shear pins or equivalent breakable members 24 so that piston 22 can translate to the right as it pushes tubing 16 with it out the circulation port 38 in the cutting structure 28. As the piston 22 passes openings 30 it enters diameter D2 and its travel is stopped by end 34 of housing 32. Tubing 16 moves in tandem with piston 22 until piston 22 hits a travel stop at end 34. The newly extending segment of tubing 16 that extends through the cutting structure 28 simply gets ground off with the coupling 26 as the window mill 10 is shear released from the whipstock that is not shown and the milling of the window commences in a known manner with the whipstock ramp guiding the window mill 10 against the surrounding tubular for the lateral exit to be made in a known manner. Fluid can now we pumped through ports 30 in housing 32, and then through circulation ports 38 in window mill 10, to lift cuttings from milling the casing exit to surface.

The above described design eliminates a need for a rupture disc to isolate window mill circulation ports as the anchor below the whipstock is set. Raising pressure after setting the anchor dislodges the piston to open ports as the piston passes by the ports into a larger diameter and gets trapped at the end of a closed housing. The piston has the end of the hydraulic line attached to it so that axial movement of the piston will push the hydraulic line out through an opening in the cutting structure of the window mill where it will be ground off once the window mill shears a retainer to the whipstock ramp and rotation starts in making the window. The piston goes into an enlarged diameter portion of the housing that captures it after its movement. The ports are far larger in cross-sectional area than the single rupture disc that was in use previously. High pressure tubing is used instead of braided metal hose for a much higher pressure rating for setting the anchor at higher pressures that could be used before. Circulation port 38 guides the tubing 16 so that the movement of the piston 22 is not impeded by line 16 kinking or folding on itself in chamber 42. The piston 22 can be guided such as with a keyway against rotation when moving axially to further reduce the possibility of the tubing 16 kinking in chamber 42.

The above description is illustrative of the preferred embodiment and many modifications may be made by those skilled in the art without departing from the invention whose scope is to be determined from the literal and equivalent scope of the claims below:

We claim:

1. An anchor setting assembly through a window mill selectively secured to a whipstock, said window mill supported by a tubular string, comprising:

a hydraulic line extending between opposed ends of a piston in pressure communication with the tubular string, said hydraulic line in a first position conducts pressure from the tubular string to only said anchor to set said anchor through said hydraulic line without piston movement, and said hydraulic line and said piston through which said hydraulic line passes initially moving in tandem to a second position after setting said anchor where, due to said tandem movement of said hydraulic line with said piston from said first to said second position, said hydraulic line extends further from the window mill and flow is enabled through at least one circulation port in said window mill.

2. The assembly of claim 1, wherein:

said piston secured against movement until a predetermined pressure is reached in the tubular string.

3. The assembly of claim 2, wherein:

said anchor sets before said predetermined pressure is reached.

4. The assembly of claim 3, wherein:

said piston is mounted in a housing disposed in a chamber of said window mill.

5. The assembly of claim 4, wherein:

said piston movable upon the breaking of a breakable member selectively retaining said piston in said housing.

6. The assembly of claim 5, wherein:

movement of said piston is guided against rotation.

7. The assembly of claim 5, wherein:

said breakable member comprises at least one shear pin.

8. The assembly of claim 4, wherein:

said housing comprises at least one port into said chamber, said chamber in fluid communication with at least one circulation port on said window mill.

9. The assembly of claim 8, wherein:

said circulation port on said window mill includes a nozzle.

10. The assembly of claim 8, wherein:

said at least one port initially isolated from said chamber by said piston.

11. The assembly of claim 10, wherein:

said housing acting as a travel stop for said piston.

12. The assembly of claim 11, wherein:

said housing comprising an opening through which said hydraulic line extends, wherein movement of said piston advances said hydraulic line through said opening.

13. The assembly of claim 12, wherein:

said hydraulic line extends through a passage and out a cutting structure of said window mill, whereupon movement of said piston said hydraulic line is advanced through said passage.

14. The assembly of claim 13, wherein:

release of said window mill from said whipstock and rotation of said window mill grinds up said hydraulic line extending from said cutting structure.

15. The assembly of claim 13, wherein:

said hydraulic line further comprises a coupling adjacent said cutting structure to facilitate mounting to said window mill.

16. The assembly of claim 8, wherein:

movement of said piston opens said at least one port.

17. The assembly of claim 16, wherein:

movement of said piston places said piston in a larger dimension of said housing than an initial position of said piston.

18. A method of setting an anchor setting assembly through a window mill selectively secured to a whipstock, said window mill supported by a tubular string, comprising:

applying pressure to a hydraulic line extending between opposed ends of a piston and in pressure communication with the tubular string without moving said piston when setting the anchor;

initially moving said hydraulic line and said piston in tandem from a first position where pressure from the tubular string is directed only to said anchor through said hydraulic line to set said anchor and a second position where, due to said tandem movement of said hydraulic line and said piston to said second position, said hydraulic line extends further from the window mill and flow is enabled through at least one circulation port in said window mill.

* * * * *